US007401666B2

(12) United States Patent
Fanuel et al.

(10) Patent No.: US 7,401,666 B2
(45) Date of Patent: Jul. 22, 2008

(54) REAMING AND STABILIZATION TOOL AND METHOD FOR ITS USE IN A BOREHOLE

(75) Inventors: Philippe Fanuel, Brussels (BE); Jean-Pierre Lassoie, Brussels (BE); Olivier Mageren, Gilly (BE); Luis Quintana, Brussels (BE); Erik Stein Moi, Hommersak (NO); Erik Dithmar, Genappe (BE)

(73) Assignee: Security DBS NV/SA, Drogenbos (BE)

( * ) Notice: Subject to any disclaimer, the term of this patent is extended or adjusted under 35 U.S.C. 154(b) by 322 days.

(21) Appl. No.: 11/147,935

(22) Filed: Jun. 8, 2005

(65) Prior Publication Data

US 2005/0274546 A1 Dec. 15, 2005

Related U.S. Application Data

(63) Continuation-in-part of application No. PCT/BE2004/000083, filed on Jun. 9, 2004.

(51) Int. Cl.
*E21B 10/32* (2006.01)

(52) U.S. Cl. ..... 175/285; 175/268; 175/269

(58) Field of Classification Search ..... 175/268, 175/292, 285, 284, 265, 267, 269
See application file for complete search history.

(56) References Cited

U.S. PATENT DOCUMENTS

| | | | | |
|---|---|---|---|---|
| 274,740 | A * | 3/1883 | Douglass | 175/267 |
| 336,187 | A | 2/1886 | Wells | 175/290 |
| 1,411,484 | A | 4/1922 | Fullilove | 175/267 |
| 1,454,843 | A | 6/1923 | Brown | 175/264 |
| 1,485,642 | A | 3/1924 | Stone | 175/268 |
| 1,607,662 | A | 11/1926 | Boynton | 175/228 |
| 1,631,449 | A | 6/1927 | Alford | 175/269 |
| 1,671,474 | A | 5/1928 | Jones | 175/269 |
| 1,686,403 | A | 10/1928 | Boynton | 175/228 |

(Continued)

FOREIGN PATENT DOCUMENTS

BE 1012545 A3 12/2000

(Continued)

OTHER PUBLICATIONS

PCT International Search Report Application No. PCT/EP2005/052613—10 pages.

(Continued)

*Primary Examiner*—Giovanna C Wright
(74) *Attorney, Agent, or Firm*—Baker Botts L.L.P.

(57) ABSTRACT

In accordance with an embodiment of the present invention, a drilling tool includes a tubular body defining a longitudinal axial cavity extending therethrough and defining at least one cutter element recess. The drilling tool also includes a cutter element at least partially disposed within the at least one cutter element recess and includes at least first and second cutting arms at least substantially disposed within the cutter element recess in a retracted position. The first and second cutting arms are operable to move from the retracted position to an extended position in which the first and second cutting arms extend at least partially beyond a periphery of the tubular body. The first and second cutting arms and the tubular body enclose a space when the first and second cutting arms are in the extended position.

25 Claims, 7 Drawing Sheets

U.S. PATENT DOCUMENTS

| | | | | | |
|---|---|---|---|---|---|
| 1,750,629 | A | * | 3/1930 | Crum | 175/278 |
| 1,772,710 | A | | 8/1930 | Denney | 166/55.8 |
| 1,804,850 | A | | 5/1931 | Triplett | 175/271 |
| 1,878,260 | A | | 9/1932 | Bunker | 175/269 |
| 2,060,352 | A | | 11/1936 | Stokes | 175/268 |
| 2,169,502 | A | | 8/1939 | Santiago | |
| 2,239,996 | A | | 4/1941 | Chappell | 175/261 |
| 2,271,472 | A | | 1/1942 | Balduf | 52/290 |
| 2,427,052 | A | | 9/1947 | Grant | 175/269 |
| 2,438,673 | A | | 3/1948 | McMahan | 175/267 |
| 2,450,223 | A | | 9/1948 | Barbour | 175/271 |
| 2,499,916 | A | | 3/1950 | Harris | 175/276 |
| 2,710,172 | A | | 6/1955 | Kammerer, Jr. | 175/268 |
| 2,754,089 | A | | 7/1956 | Kammerer, Jr. | 175/268 |
| 2,758,819 | A | | 8/1956 | Kammerer, Jr. | 255/76 |
| 2,809,015 | A | | 10/1957 | Phipps | 175/232 |
| 2,822,150 | A | | 2/1958 | Muse et al. | 175/266 |
| 2,834,578 | A | | 5/1958 | Carr | 255/73 |
| 2,872,160 | A | | 2/1959 | Barg | 175/269 |
| 2,882,019 | A | | 4/1959 | Carr et al. | 255/73 |
| 3,105,562 | A | | 10/1963 | Stone et al. | 175/268 |
| 3,123,162 | A | | 3/1964 | Rowley | 175/325.4 |
| 3,180,436 | A | | 4/1965 | Kellner et al. | 175/57 |
| 3,224,507 | A | | 12/1965 | Cordary et al. | 166/55.8 |
| 3,351,144 | A | | 11/1967 | Park | 175/269 |
| 3,365,010 | A | | 1/1968 | Howell et al. | 175/286 |
| 3,425,500 | A | | 2/1969 | Fuchs | 175/269 |
| 3,433,313 | A | | 3/1969 | Brown | 175/270 |
| 3,556,233 | A | | 1/1971 | Gilreath et al. | 175/267 |
| 3,749,184 | A | | 7/1973 | Andeen | 175/18 |
| 3,974,886 | A | | 8/1976 | Blake, Jr. | 175/76 |
| 4,055,226 | A | | 10/1977 | Weber | 175/273 |
| 4,081,042 | A | | 3/1978 | Johnson et al. | 175/267 |
| 4,091,883 | A | | 5/1978 | Weber | 175/287 |
| 4,141,421 | A | | 2/1979 | Gardner | 175/263 |
| 4,177,866 | A | | 12/1979 | Mitchell | 175/53 |
| 4,186,810 | A | | 2/1980 | Allan | 175/96 |
| 4,190,124 | A | | 2/1980 | Terry | 175/406 |
| 4,411,557 | A | * | 10/1983 | Booth | 405/238 |
| 4,458,761 | A | | 7/1984 | Van Vreeswyk | 166/289 |
| 4,503,919 | A | | 3/1985 | Suied | 175/269 |
| 4,589,504 | A | | 5/1986 | Simpson | 175/267 |
| 4,660,657 | A | | 4/1987 | Furse et al. | 175/269 |
| 4,821,817 | A | | 4/1989 | Cendre et al. | 175/269 |
| 4,842,083 | A | | 6/1989 | Raney | 175/325.4 |
| 4,889,197 | A | | 12/1989 | Boe | 175/267 |
| 4,915,181 | A | | 4/1990 | Labrosse | 175/263 |
| 5,010,967 | A | | 4/1991 | Desai | 175/406 |
| 5,036,921 | A | | 8/1991 | Pittard et al. | 166/298 |
| 5,060,738 | A | | 10/1991 | Pittard et al. | 175/267 |
| 5,086,852 | A | | 2/1992 | Van Buskirk | 175/269 |
| 5,139,098 | A | | 8/1992 | Blake | 175/269 |
| 5,184,687 | A | | 2/1993 | Abdrakhmanov et al. | 175/267 |
| 5,255,741 | A | | 10/1993 | Alexander | 166/278 |
| 5,265,684 | A | | 11/1993 | Rosenhauch | 175/61 |
| 5,271,472 | A | | 12/1993 | Leturno | 175/107 |
| 5,318,137 | A | | 6/1994 | Johnson et al. | 175/40 |
| 5,318,138 | A | | 6/1994 | Dewey et al. | 175/74 |
| 5,330,016 | A | | 7/1994 | Paske et al. | 175/320 |
| 5,332,048 | A | | 7/1994 | Underwood et al. | 175/26 |
| 5,348,095 | A | | 9/1994 | Worrall et al. | 166/380 |
| 5,368,114 | A | | 11/1994 | Tandberg et al. | 175/267 |
| 5,560,440 | A | | 10/1996 | Tibbitts | 175/384 |
| 5,590,724 | A | | 1/1997 | Verdgikovsky | 175/57 |
| 5,655,609 | A | | 8/1997 | Brown et al. | 175/76 |
| 5,788,000 | A | | 8/1998 | Maury et al. | 175/325.1 |
| 5,957,222 | A | | 9/1999 | Webb et al. | 175/45 |
| 5,957,226 | A | | 9/1999 | Holte | 175/320 |
| 6,059,051 | A | | 5/2000 | Jewkes et al. | 175/76 |
| 6,070,677 | A | | 6/2000 | Johnston, Jr. | 175/57 |
| 6,131,675 | A | | 10/2000 | Anderson | 175/268 |
| 6,189,631 | B1 | | 2/2001 | Sheshtawy | 175/284 |
| 6,209,665 | B1 | | 4/2001 | Holte | 175/273 |
| 6,213,226 | B1 | | 4/2001 | Eppink et al. | 175/61 |
| 6,244,664 | B1 | | 6/2001 | Ebner et al. | 299/80.1 |
| 6,269,893 | B1 | | 8/2001 | Beaton et al. | 175/391 |
| 6,289,999 | B1 | | 9/2001 | Dewey et al. | 175/38 |
| 6,360,830 | B1 | | 3/2002 | Price | 175/52 |
| 6,360,831 | B1 | | 3/2002 | Åkesson et al. | 175/269 |
| 6,378,632 | B1 | | 4/2002 | Dewey et al. | 175/269 |
| 6,419,025 | B1 | | 7/2002 | Lohbeck et al. | 166/380 |
| 6,427,788 | B1 | | 8/2002 | Rauchenstein | 175/269 |
| 6,464,024 | B2 | | 10/2002 | Beaton et al. | 228/19 |
| 6,668,949 | B1 | | 12/2003 | Rives | 175/269 |
| 6,732,817 | B2 | | 5/2004 | Dewey | 175/57 |
| 2003/0079913 | A1 | | 5/2003 | Eppink et al. | 175/61 |
| 2003/0155155 | A1 | | 8/2003 | Dewey et al. | 175/57 |
| 2004/0065479 | A1 | | 4/2004 | Fanuel | 175/267 |
| 2004/0065480 | A1 | | 4/2004 | Fanuel et al. | 175/269 |
| 2004/0134687 | A1 | | 7/2004 | Radford et al. | 175/57 |

FOREIGN PATENT DOCUMENTS

| | | | |
|---|---|---|---|
| DE | 2 839 868 | A1 | 4/1979 |
| EP | 0 086 701 | A1 | 8/1983 |
| EP | 0 301 890 | A2 | 2/1989 |
| EP | 0 577 545 | A1 | 3/1993 |
| EP | 0 568 292 | A1 | 11/1993 |
| FR | 569203 | | 4/1924 |
| GB | 218774 | | 7/1924 |
| GB | 295150 | | 8/1928 |
| GB | 540027 | | 10/1941 |
| GB | 1 586 163 | | 3/1981 |
| GB | 2 128 657 | A | 5/1984 |
| GB | 2 180 570 | A | 4/1987 |
| NL | 8 503 371 | | 7/1987 |
| WO | WO 00/31371 | | 6/2000 |
| WO | WO 02/072994 | A1 | 9/2002 |

OTHER PUBLICATIONS

PCT/EP2005/052613, 3 pgs.

Notification of International Search Report for International Application No. PCT/BE02/00031, filed May 7, 2002 (7 pages).

PCT International Preliminary Examination Report for International Application No. PCT/BE/00031; filed Mar. 12, 2002.

UK Search Report for GB Application No. GB 0323195.8 (1 page), Dec. 11, 2003.

Belgium Search Report for International Application No. PCT/BE02/00031, (3 pages—including cover letter dated Oct. 5, 2004), Sep. 17, 2004.

Notification of International Search Report and Written Opinion for International Application No. PCT/BE2004/000057, filed Apr. 21, 2004 (11 pages).

Notification of International Search Report and Written Opinion for International Application No. PCT/BE2004/000083, filed Jun. 9, 2004 (11 pages).

PCT International Search Report Application No. PCT/EP2005/052613 - 10 pages.

* cited by examiner

REAMING AND STABILIZATION TOOL AND METHOD FOR ITS USE IN A BOREHOLE

CROSS-REFERENCE TO RELATED APPLICATIONS

This application is a Continuation-in-Part of International Patent Application Serial No. PCT/BE2004/000083 entitled "Reaming and Stabilization Tool For Use in a Borehole" filed on Jun. 9, 2004.

TECHNICAL FIELD OF THE INVENTION

This invention relates in general to earth formation drilling, and more particularly to a reaming and stabilization tool and method for its use in a borehole.

BACKGROUND OF THE INVENTION

Earth formation drilling is often accomplished using a long string of drilling pipes and tools coupled together. The drilling string is rotated together in order to rotate a cutting bit at the end of the string. This cutting bit creates the hole which the rest of the drilling string moves through. For various reasons, it may be desirable to widen the walls of the hole after it has been created by the cutting bit. Bore-hole underreamers exist to accomplish the widening of the hole. An underreamer may be coupled to the drilling string between two other elements of the drilling string. It may then be sent down hole with the drilling string, rotating with the drilling string, and widening the hole.

SUMMARY OF THE INVENTION

In accordance with the present invention, the disadvantages and problems associated with underreamer life span and functionality have been substantially reduced or eliminated. In particular, the problem of clogging of the underreamer, which may prevent proper retraction of the cutting arms and thereby cause premature breakage of the cutting arms, has been reduced or eliminated.

In accordance with one embodiment of the present invention, a drilling tool includes a tubular body defining a longitudinal axial cavity extending therethrough and defining at least one cutter element recess. The drilling tool also includes a cutter element at least partially disposed within the at least one cutter element recess and includes at least first and second cutting arms at least substantially disposed within the cutter element recess in a retracted position. The first and second cutting arms are operable to move from the retracted position to an extended position in which the first and second cutting arms extend at least partially beyond a periphery of the tubular body. The first and second cutting arms and the tubular body enclose a space when the first and second cutting arms are in the extended position.

Technical advantages of certain embodiments of the present invention include expandable underreaming or cutting arms which have significant thickness, yet are still capable of substantially retracting within the underreamer body when not in use. A thicker, more massive cutting arm will be better able to withstand the forces exerted by the formation being cut. Increasing the thickness of the cutting arms may hamper the flow of drilling fluids through the underreamer. Therefore, the underreamer has been designed with thick cutting arms that do not significantly impinge the flow of the drilling fluid.

Another technical advantage of certain embodiments of the present invention is a clogging resistant design. The cutting arms at full extension will project beyond the body of the underreamer. However, the space formed under the cutting arms may remain closed off from the drilling mud and debris circulating around the exterior of the underreamer. This is the case because the apex of the angle formed under the cutting arms does not extend beyond the periphery of the tubular body. For example, it lies outside of a recess defined by the tubular body for the cutting arms. The cutting arms are also sized to correspond to the opening through which they extend. This design prevents debris from clogging the space behind the cutting arms reducing the possibility that the cutting arms are prevented from retracting into the underreamer. Further, jets of drilling fluid from the interior of the underreamer may be directed into the space under the cutting arms to maintain a flow of drilling fluid away from areas which may otherwise become clogged.

Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
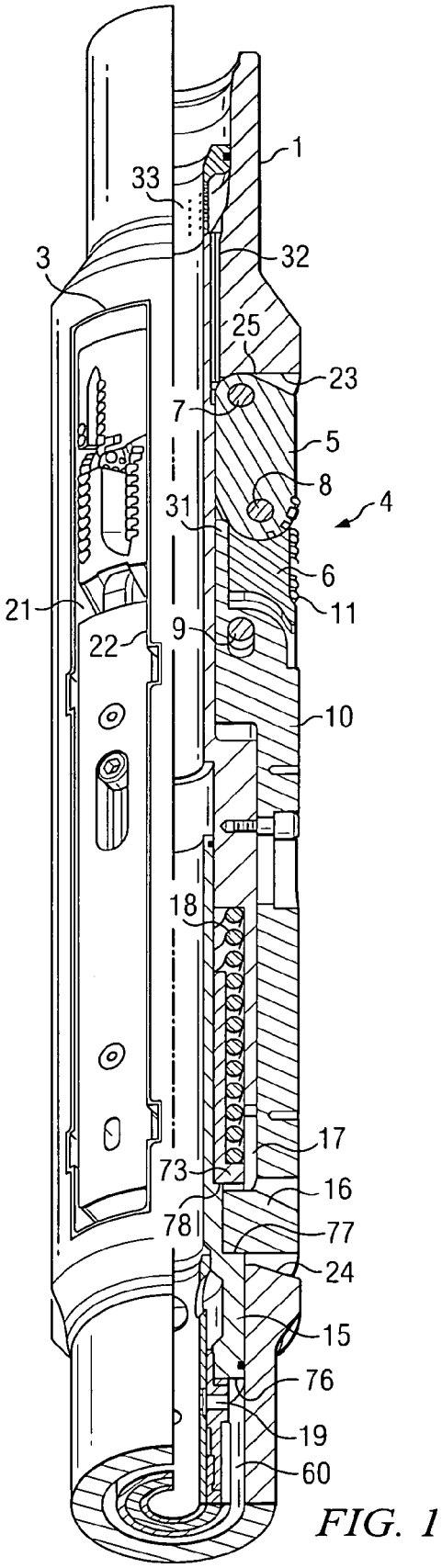
FIG. 1 illustrates a perspective view with portions broken away of a tool according to a particular embodiment of the invention in the retracted position.

The present invention relates to a reaming and stabilization tool to be used in a borehole. One embodiment of the present invention may include a tubular body to be mounted between a first section of a drill string and a second section of the drill string. The tubular body may have an axial cavity and, peripherally, housings provided with openings to the outside. A cutter element may be housed in each housing. The cutter element may include at least two cutting arms articulated on each other and on the tubular body. The cutting arms are able to be moved between a retracted position in which they are situated inside their housing and an extension position in which they are deployed outside.

The tool may also include a drive mechanism arranged inside the tubular body so as to be axially offset with respect to the cutter elements. The drive mechanism is capable of effecting a movement between two extreme positions. The tool may also include a transmission mechanism capable of transmitting the movement of the drive mechanism to the articulated cutting arms of each cutter element. In a first of the extreme positions of the drive mechanism, the cutting arms of each cutter element may be in their retracted position and, in a second of the extreme positions, the cutting arms may be in their extension position.

The production of cutter elements in the form of articulated cutting arms offers the advantage of being able to provide large-diameter drill hole reaming. However, cutting arms which greatly project out of the tubular body present the danger of rapid clogging of the articulations of the cutting arms and their housings, which may prevent the correct functioning of the tool. Moreover, in their position deployed greatly outside the body of the tool, the articulations of the cutting arms may be subjected to enormous forces due to the resistance of the formation to be eroded during the rotation of the tool and its progressive axial sinking into it, which may cause rapid damage to these articulations.

To resist these stresses, the articulated cutting arms may be designed so as to be solid, which may result in relatively bulky cutting arms. In their retracted position the cutting arms should allow the circulation of drilling mud, without hindrance, inside the tubular body of the tool. This consideration complicates the interaction between the drive mechanism and the cutting arms.

Particular embodiments of the present invention include a reaming and stabilization tool which is very strong, offers possibilities of reaming greater than the tools currently available on the market and prevents the aforementioned problems of clogging.

To resolve these problems, according to the invention, a reaming and stabilization tool to be used in a borehole, as described above, has been provided. The tool may further include the cutting arms in the extension position forming between them and the tubular body of the tool a space which is closed off from the exterior of the tool. The chips resulting from the drilling and/or reaming may not penetrate below the articulations of the cutting arms. Even in the extension position, the housing may not be clogged by the chips circulating around the tubular body and cutting arms. According to a particular embodiment, the tool may have a ratio between the diameter of the borehole enlarged by the cutting arms in the extension position and the outside diameter of the tool greater than or equal to 1.3, perhaps, for example, 1.5.

According to one embodiment of the invention, the cutting arms have, between their retracted position and their extension position, an intermediate position. Beyond this intermediate position, a movement of the cutting arms towards the extension position causes a force exerted on the cutting arms by a formation to be eroded to be converted by the transmission mechanism into a traction on the drive mechanism in the direction of its second extreme position. Although the cutting arms prevent chips from entering the space below them, the angle between the cutting arms is sufficiently small that the reaction force exerted by the formation to be eroded on the cutting arms is in the same direction as the force exerted by the drive mechanism on the cutting arms to bring them into the extension position. The system thus becomes self-locking in the extension position and the drive force no longer needs to be applied to maintain the cutting arms in the extension position.

Each cutter element may include first and second cutting arms. The first cutting arm may be articulated first on the tubular body by a first pivot shaft and second on the second cutting arm by a second pivot shaft. The second cutting arm may be articulated by the second pivot shaft and a third pivot shaft on the transmission mechanism. In the extension position of the cutting arms, only the second pivot shaft is situated outside the tool. In this way, in the extension position of the cutting arms, the closed space formed between the two cutting arms and the tubular body has a triangular shape having an angle at the vertex that is situated inside the housing.

According to one embodiment of the invention, the drive mechanism may be a hollow piston capable of sliding in the axial cavity of the tubular body. The transmission mechanism may include, for each housing, a transmission element coupled to each cutter element. Each transmission element may be capable of sliding in its housing. An elongate slot may be provided in the tubular body between the housing and the axial cavity. A projection on the transmission element may pass through the slot and bear on the hollow piston so as to follow the hollow piston in its axial movement. The hollow piston may close off fluid communication between the housings and the axial cavity in the tubular body, while allowing circulation of drilling mud through the tool. This embodiment may allow an arrangement of the drive mechanism offset with respect to the cutter elements. This allows the cutting arms to have a maximum thickness as the housing can extend in from the periphery of the tubular body as far as the axial passage where the muds circulate.

According to an alternative embodiment of the invention, each housing may have a bottom, two parallel lateral walls disposed at a distance from each other and two front walls. Each cutting arm and the transmission element may have a width corresponding to the distance between the lateral walls and be capable of sliding along the lateral walls during extension of the cutting arms. The cutting arms may be laterally in abutment on each of the lateral walls. A first cutting arm at a first end and one of the front walls may bear on each other through first mutually cooperating surfaces. The first cutting arm at a second end and a second cutting arm at a first end may bear on each other through second cooperating surfaces. The second cutting arm at a second end and the transmission element at a first end may bear on each other through third cooperating surfaces. In this way, the cutting arms of the tool are supported in their extension position by the walls of the housing and the transmission element. The forces on the cutting arms are transmitted by the cutting arms to other parts of the tool through mutual abutments on surfaces conformed so as to be able to cooperate, or support the cutting arms. This relieves the pivot shafts of these tensions.

According to another embodiment of the invention, the tool may include an activation device. The activation device may axially hold the hollow piston inside the tubular body in an initial position corresponding to a retracted position of the cutting arms in their housings. The activation device may be capable of releasing the hollow piston at a suitable moment, thereby allowing the hollow piston to perform its axial movement according to a hydraulic fluid pressure. The tool may include at least one return spring that opposes the axial movement and directs the hollow piston towards its initial position. The tool according to the invention may also include a capture device inside the tubular body. The capture device may be activated to a capture position in which the hollow piston is captured by the capture device when, under the action of the return spring, the hollow piston regains its initial position. In a particular embodiment, the tool may include the activation device and the capture device arranged on only one side of the hollow piston. Such an arrangement may make it possible to avoid the presence or passage of constructional elements of the tool between the housings of the cutting arms and the axial cavity in the tubular body through which the drilling muds circulate.

Further details and particularities of the invention will emerge from the description given below non-limitingly and with reference to the accompanying drawings.

FIGS. 1 to 4 illustrate a reaming and stabilization tool to be used in a borehole, in accordance with a particular embodiment. This tool includes a tubular body 1 to be mounted between first and second sections of a drill string. This tubular body 1 has an axial cavity 2 in which drilling muds may circulate. At the periphery, tubular body 1 includes housings 3 provided with openings through the periphery of tubular body 1 to the outside.

Figure 2:
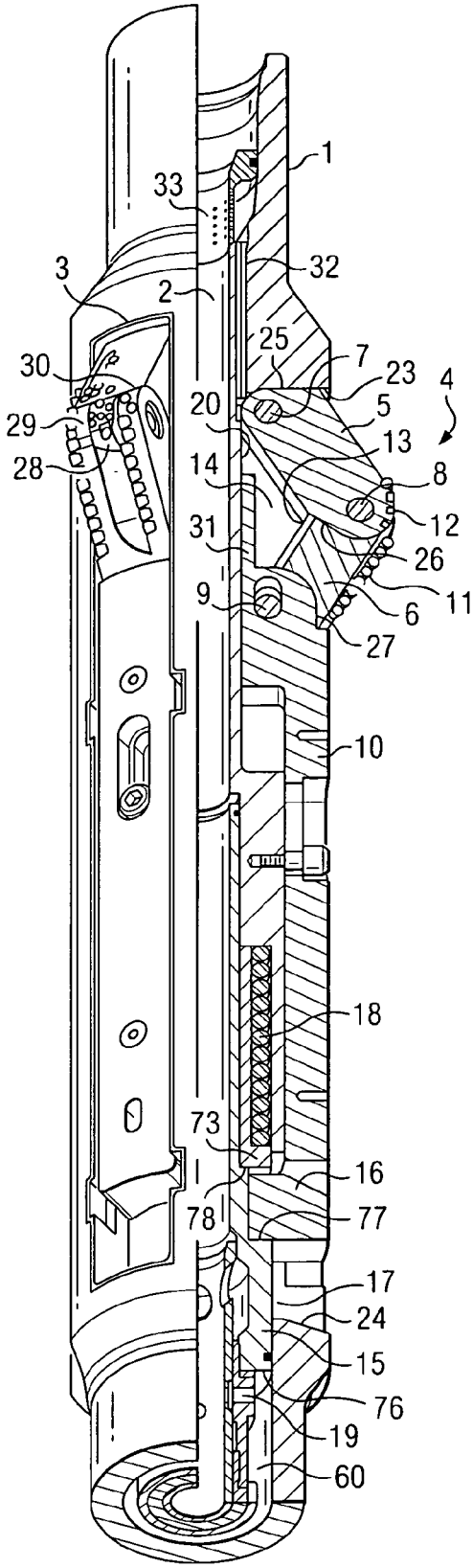
FIG. 2 illustrates a perspective view with portions broken away of a tool according to a particular embodiment of the invention in the extension position.
Figure 3:
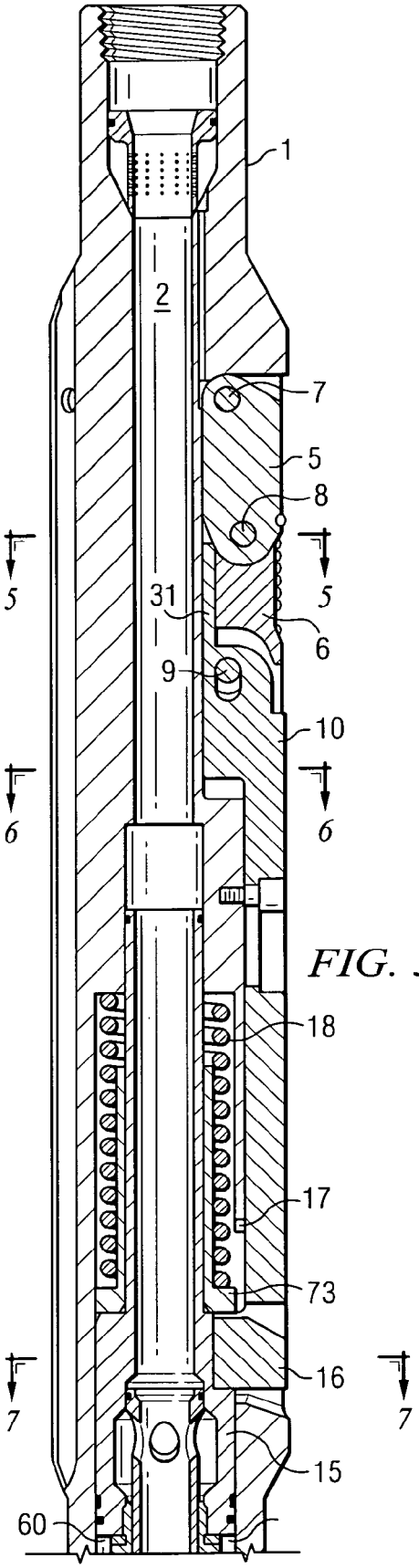
FIG. 3 illustrates a longitudinal cross section of an upstream portion of a tool in accordance with one embodiment of the present invention.

In the example illustrated, a cutter element 4 is housed in each housing 3 and includes two cutting arms 5 and 6 operable to articulate on each other. Cutting arm 5 is articulated on tubular body 1 by pivot shaft 7 and on cutting arm 6 by pivot shaft 8. Cutting arm 6 is also articulated by pivot shaft 9 on a transmission mechanism, which is, in the example illustrated, in the form of a transmission element 10. The retracted position of cutting arms 5 and 6 in their housing 3 is illustrated in FIGS. 1 and 3, and their extension position is illustrated in FIG. 2.

Cutter elements 4 may have more articulated cutting arms than two. Moreover, cutter elements 4 are provided with cutting tips, and the surfaces of cutting arms 5 and 6 are conformed, in the example illustrated, to have in the extension position a front area 11. Front area 11 is inclined towards the front, or downhole, side of the tool, and is intended to produce an enlargement of the borehole during the descent of the tool. Cutting arms 5 and 6 also include a central area 12 that is substantially parallel to the axis of the tool in the extension position of the cutting arms 5 and 6. Central area 12 is intended to stabilize the tool with respect to the broadened hole. It is also possible to provide a rear, or uphole, area with cutting tips operable to produce a broadening of the borehole when the drill string is being raised.

Housings 3 are recessed into tubular body 1 and extend inward almost to axial cavity 2. The full depth of housing 3 may be occupied by cutting arms 5 and 6. In this way, the thickness of the cutting arms 5 and 6 may be maximized because the majority of the diameter of tubular body 1 not dedicated to axial cavity 2 may be occupied by cutting arms 5 and 6. This design also includes an adequate axial cavity 2 to allow passage of the drilling muds without hindrance.

In the extension position, cutting arms 5 and 6 form between them and tubular body 1 a space 14. Space 14 has a triangular shape in a profile view, and is closed off from the drilling muds circulating outside tubular body 1. As can be seen in FIG. 2, the angle at the vertex 13 of this triangular space 14 is also situated inside the recess defined by longitudinal body 1, and chips resulting from the underreaming, or from a drilling operation, typically cannot enter this closed space.

A drive mechanism, which, in the example embodiment illustrated, is designed in the form of a hollow piston 15, is arranged inside tubular body 1. Hollow piston 15 is in a position axially offset with respect to cutter elements 4, or in other words, hollow piston 15 is not located beneath cutter elements 4. Axial cavity 2 may have a larger diameter than would have otherwise been possible with a coaxial design of cutter elements 4 and hollow piston 15. This design allows circulation of the drilling muds without hindrance inside tubular body 1.

A transmission element 10 is disposed in each housing 3 so as to be able to move longitudinally therein. At its opposite end to that articulated on cutting arm 6, each transmission element 10 has, in this example, a projection 16 which enters inside tubular body 1 through an elongate slot 17. Transmission elements 10 bear on hollow piston 15 and follow hollow piston 15 in its axial movements.

Hollow piston 15 separates axial cavity 2 from tubular body 1, and also separates axial cavity 2 from housings 3. In the example illustrated, front face 76 of hollow piston 15 is in contact with the drilling mud circulating inside axial cavity 2 of tubular body 1. These muds are able to accumulate in annular chamber 60, through radial holes 19 in communication with axial cavity 2. The rear faces 77 and 78 of hollow piston 15 are in abutment with the projections 16 of transmission elements 10 and return spring seat 73, respectively. Return spring 18 and transmission element 10 are in communication with the drilling fluid circulating outside tubular body 1 through the opening to the outside of the housings 3. Return spring 18 and transmission element 10 are therefore exposed to the pressure of the hydraulic fluid present in the borehole, i.e., the drilling fluid circulating outside tubular body 1. Return spring 18 also abuts tubular body 1 at the end of return spring 18 opposite front face 76 of hollow piston 15.

Figure 6:
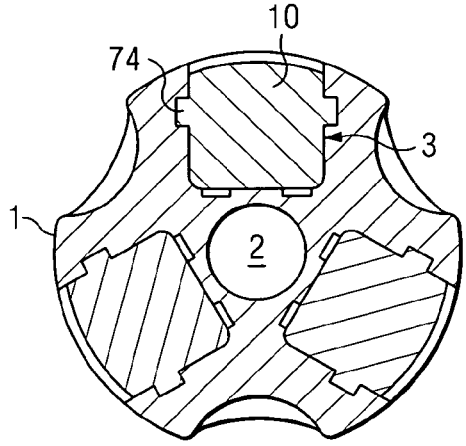
FIG. 6 illustrates a transverse cross-section view of the tool illustrated in FIGS. 3 and 4 through the line 6-6.
Figure 7:
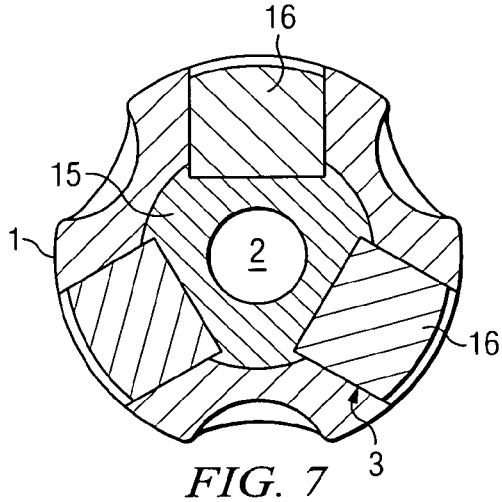
FIG. 7 illustrates a transverse cross-section view of the tool illustrated in FIGS. 3 and 4 through the line 7-7.

Hollow piston 15 can slide between two extreme positions. The first position is illustrated in FIG. 1, where the internal hydraulic pressure does not exceed the external pressure plus the force of return spring 18. The second position is illustrated in FIG. 2, where the internal hydraulic pressure exceeds the external pressure plus the force of return spring 18. When the internal pressure exceeds the external pressure plus the force of return spring 18, return spring 18 is compressed by movement of hollow piston 15 upwards. This movement causes an upward movement of transmission element 10, and a deployment of cutting arms 5 and 6 to the extension position. In the example illustrated, transmission elements 10 are held radially in their housing by lateral lugs 74 (see FIG. 6), which may longitudinally move in lateral slots in tubular body 1. Lateral lugs 74 prevent a radial detachment of transmission elements 10.

In any position of hollow piston 15, hollow piston 15 closes off fluid communication between housings 3 and axial cavity 2. However, hollow piston 15 allows drilling muds to circulate through axial cavity 2 of the tool.

Each housing 3 has a bottom 20 (see FIG. 2), two parallel lateral walls 21 and 22 (see FIG. 1), and two front walls 23 and 24 (see FIG. 1).

As can be seen in FIGS. 1 and 2, cutting arms 5 and 6 and transmission element 10 each have a width corresponding to the distance between the two lateral walls 21 and 22. When moving between the retracted and extension positions, cutting arms 5 and 6 slide along lateral walls 21 and 22, and transmission element 10 moves along lateral walls 21 and 22 and over bottom 20 of housing 3. During this movement, the space 14 is not open to the outside.

As illustrated in FIG. 2, in the extension position of cutting arms 5 and 6, cutting arm 5 and front wall 23 of the housing bear on each other through mutually cooperating surfaces at 25. Likewise, cutting arm 5 and cutting arm 6 bear on each other through mutually cooperating surfaces at 26. Cutting arm 6 and the end of transmission element 10 on which it is articulated bear on each other through mutually cooperating surfaces at 27. This arrangement allows, in the extension position of the cutting arms 5 and 6, transmission of the external forces exerted on cutting arms 5 and 6 from cutting arms 5 and 6 to tubular body 1.

In the extension position, cutting arms 5 and 6 are designed to be largely supported by lateral walls 21 and 22 against the forces exerted by the resistance of the formation to be eroded during the rotation of the tool. Lateral walls 21 and 22 of housing 3 also frame transmission elements 10. Only pivot shaft 8 of cutting arms 5 and 6 is situated outside housing 3, while pivot shafts 7 and 9 are disposed within housing 3. The resistance forces exerted by the formation to be eroded during the forward progression of the tool and the forces exerted by the tool on the formation by cutting arms 5 and 6 are principally absorbed by cutting arms 5 and 6 and transmission element 10. This relieves pivot axes 7, 8 and 9 of the majority of these stresses.

Figure 5:
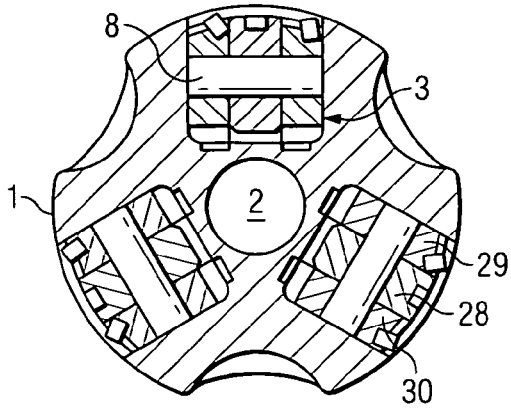
FIG. 5 illustrates a transverse cross-section view of the tool illustrated in FIGS. 3 and 4 through the line 5-5.

As illustrated in FIG. 5, cutting arms 5 and 6 are articulated on each other through fingers 28, 29, and 30. Fingers 28, 29, and 30 fit together such that fingers 28, 29 and 30 have a total width corresponding to the distance between lateral walls 21 and 22 of housing 3. Similar fingers may be provided at the articulation between transmission element 10 and cutting arm 6.

To facilitate triggering extension of cutting arms 5 and 6 from their retracted position, pivot axis 8 may be offset towards the outside of tubular body 1 with respect to a plane passing through pivot axes 7 and 9. In the example illustrated, transmission element 10 includes a triggering finger 31, which, as illustrated in FIGS. 1 and 3, is in contact with the bottom of cutting arm 5 in the retracted position of cutter element 4. Triggering finger 31 is arranged to be able to move under cutting arm 6 and raise cutting arm 5 as transmission element 10 moves over the bottom 20 of its housing 3.

Figure 12:
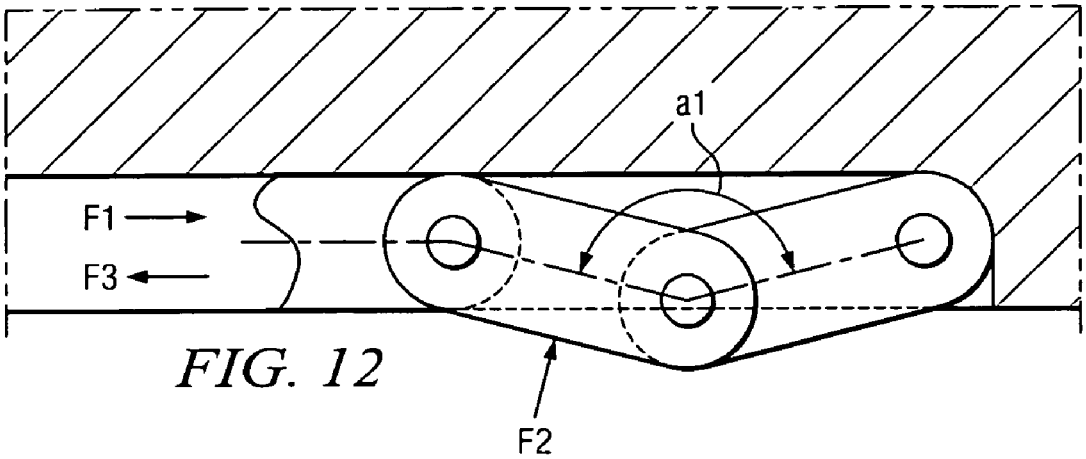
FIG. 12 is a schematic representation of the forces acting on the cutting arms at the start of extension.

As illustrated in FIG. 12, when the extension of cutting arms 5 and 6 is triggered, an obtuse angle is formed between cutting arms 5 and 6. Cutting arm 6 receives a drive force F1 from transmission element 10, which is oriented towards the right in FIG. 12. The formation to be eroded reacts with a force F2 directed onto cutting arm 6. Force F2 transmits to transmission element 10 a thrust force F3 in the opposite direction of driving force F1.

Figure 13:
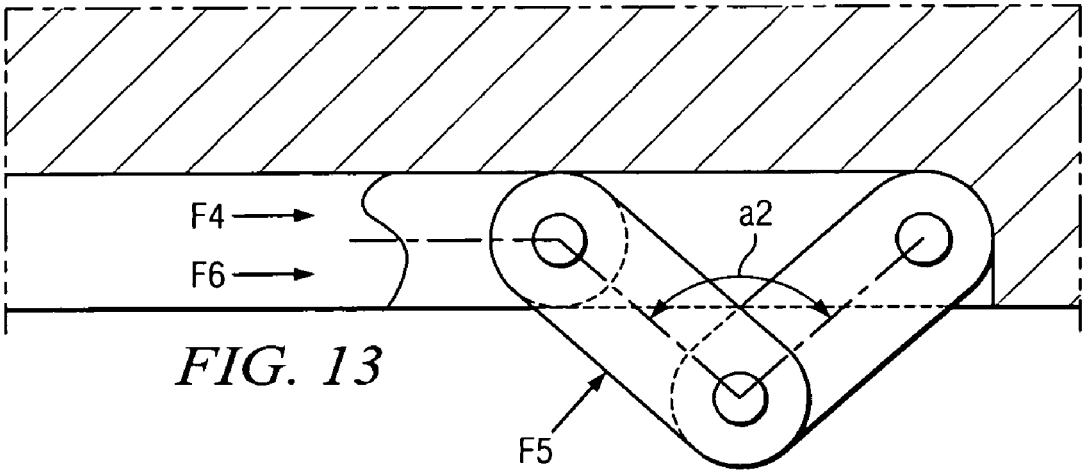
FIG. 13 is a schematic representation of the forces acting on the cutting arms at full extension.

In the extension position illustrated in FIG. 13, cutting arms 5 and 6 form between them an angle a2. Angle a2 is appreciably smaller than angle a1. In the extension position, reaction force F5 from the formation to be eroded is directed onto cutting arm 6 such that force F6 transmitted to transmission element 10 is directed in the same direction as driving force F4. In this manner, the system is self-locking in the extension position and it is possible to dispense with drive force F4 of hollow piston 15.

There exists between the retracted position and the extension position an intermediate position of cutting arms 5 and 6 at which the resistance force from the formation to be eroded becomes a traction force on the drive mechanism. However, in the extension position, which is very favorable from the kinematic point of view, space 14 of housing 3 remains closed to the outside.

To further prevent penetration of external hydraulic fluid, which may be filled with chips, into housing 3, a strangled passage 32 may be provided between each closed space 14 and axial cavity 2. Strangled passage 32 allows injection into space 14 of jets of internal hydraulic fluid under high pressure. This injection prevents penetration of external hydraulic fluid into space 14, and simultaneously cleans cutting arms 5 and 6. In the example illustrated, strangled passages 32 are in communication with axial cavity 2 through perforations 33, which also serve as filters.

Figure 9:
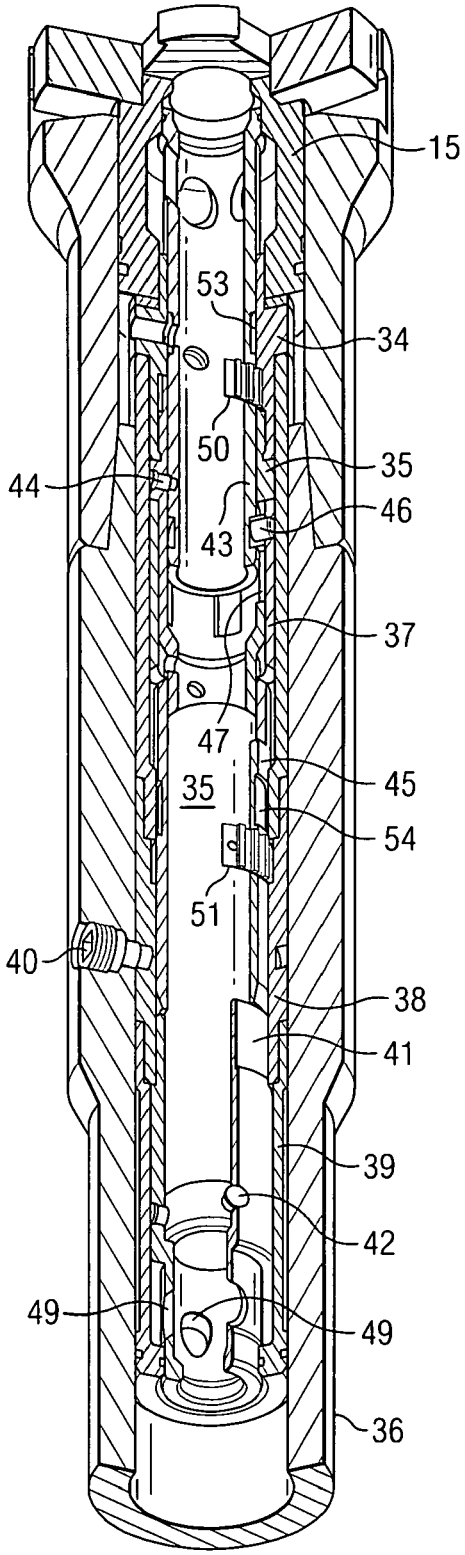
FIG. 9 illustrates a perspective view, with portions broken away, of activation and capture devices in first positions of the activation and capture devices.
Figure 10:
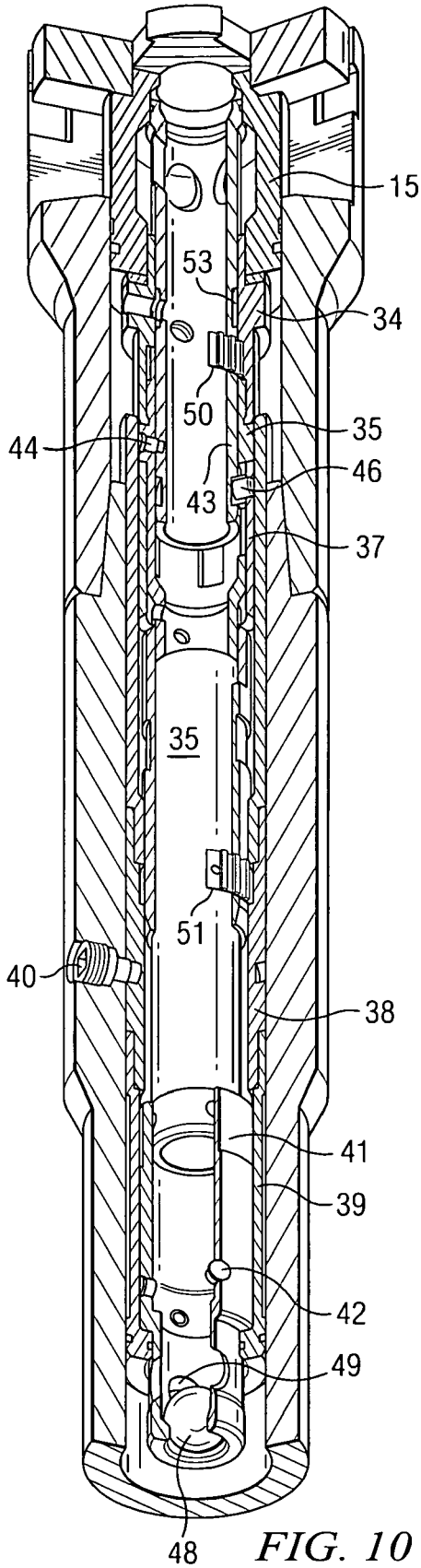
FIG. 10 illustrates a perspective view, with portions broken away, of activation and capture devices in a second position of the activation device and the first position of the capture device.

In a particular embodiment, illustrated in FIGS. 9 and 10, the tool includes an activation device and a capture device. The activation and capture devices may both be situated downstream from hollow piston 15 while cutter elements 4 may be situated upstream from hollow piston 15. This configuration reduces or eliminates the need to have moving parts coaxial with cutter elements 4, which may have the disadvantage of reducing the possible thickness of cutting arms 5 and 6 and the volume of housings 3.

The activation device may be capable of axially holding hollow piston 15 inside tubular body 1 in an initial position. The initial position corresponds to the retracted position of cutting arms 5 and 6, and facilitates the descent of the tool into the borehole to a location where underreaming is desired. When the tool has arrived at the location to be underreamed, the activation device releases hollow piston 15, enabling it to perform its axial movement.

In the example illustrated, hollow piston 15 is extended by two successive extension tubes 34 and 35 that are screwed onto hollow piston 15. Extension tubes 34 and 35 extend inside tubular body 1, which is itself extended by a joining element 36. Joining element 36 couples tubular body 1 to the drill string. Joining element 36 is covered in its internal cavity with three successive sockets 37, 38, and 39 that are screwed onto each other and are fixed on joining element 36 by fixing pins 40.

At the downstream, or downhole, end of socket 39 of joining element 36, there is arranged an external tubular slide 41 that is coupled to extension tube 35 of hollow piston 15 by several shear pins 42.

Inside extension tube 34 and hollow piston 15, there is arranged an internal tubular slide 43. Tubular slide 43 is coupled firstly to extension tube 34 by shear pins 44 and secondly to a sleeve 45 disposed between extension tube 35 and the successive sockets 37, 38, and 39 of joining element 36 of tubular body 1, by coupling pins 46. Coupling pins 46 are passed through elongate slots 47 provided in the axial direction in extension tube 35.

In one embodiment, the tool may have a stop mechanism that prevents axial sliding of external tubular slide 41 and hollow piston 15 in the non-activated position of the tool. In this position, illustrated in FIGS. 4 and 9, fixed socket 37 prevents a downstream sliding of extension tube 34. Socket 38 abuts a shoulder on external tubular slide 41. External tubular slide 41 is coupled to extension tube 35 of hollow piston 15 by shear pins 42. Shear pins 42 prevent sliding towards the upstream of the assembly formed by external tubular slide 41 and extension tube 35.

An obturation ball 48 may be introduced into axial cavity 2, thereby closing off the cavity in external tubular slide 41. This causes the hydraulic pressure inside axial cavity 2 to increase abruptly. Under the effect of this increase in pressure as well as the mechanical impact of obturation ball 48 on external tubular slide 41, shear pins 42 are sheared, and hollow piston 15 is released to slide in the upstream direction. External tubular slide 41 is projected forward, or downhole, into the position depicted in FIG. 10, and the flow of hydraulic fluids is re-established through lateral holes 49, which become unobstructed.

An increase in hydraulic pressure in chamber 60 directs hollow piston 15 upwards, thereby compressing return spring 18. Conversely, a reduction in pressure allows hollow piston 15 to return to its initial position under the direction of return spring 18. Hollow piston 15 can thus fulfill its role as a driving mechanism for cutting arms 5 and 6.

Figure 4:
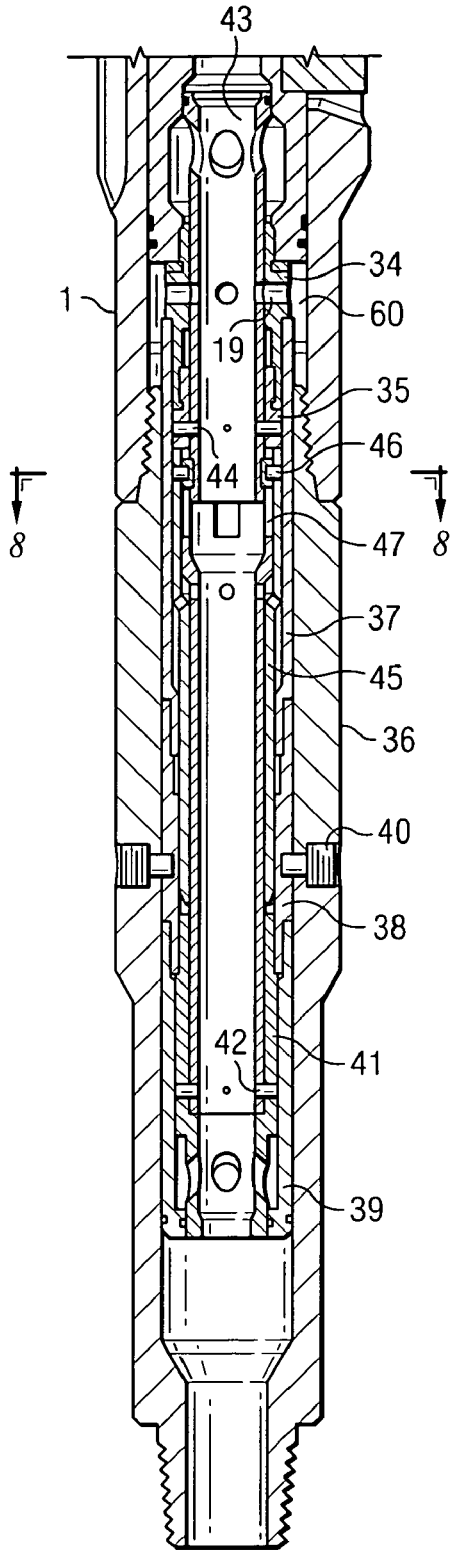
FIG. 4 illustrates a longitudinal cross section of a downstream portion of the tool of FIG. 3 in accordance with one embodiment of the present invention.
Figure 8:
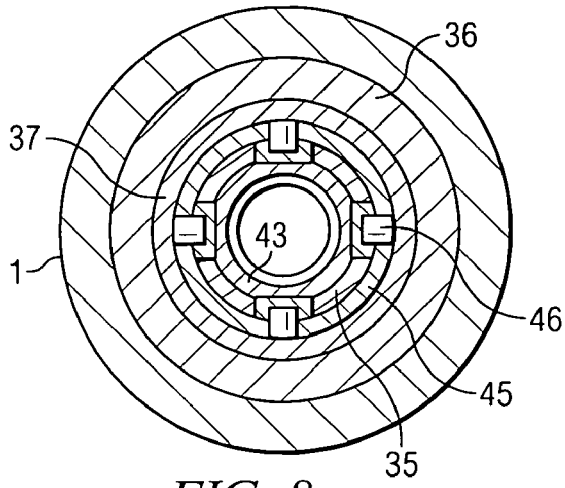
FIG. 8 illustrates a transverse cross-section view of the tool illustrated in FIGS. 3 and 4 through the line 8-8.

At the end of use of the tool, it may be desirable to raise the tool from the borehole. Raising the tool is facilitated by capturing hollow piston 15 in its initial position with cutting arms 5 and 6 in the retracted position. Throughout the functioning of the tool, the capture device is in a non-activated position, as illustrated in FIGS. 4, 9, and 10.

In the non-activated position, extension tube 34 of hollow piston 15 is provided with an internal housing in which there is arranged an elastic clamping collar 50. Elastic clamping collar 50 surrounds internal tubular slide 43. Socket 38 of joining element 36 is also provided with an internal housing in which there is arranged another elastic clamping collar 51, which surrounds sleeve 45.

Figure 11:
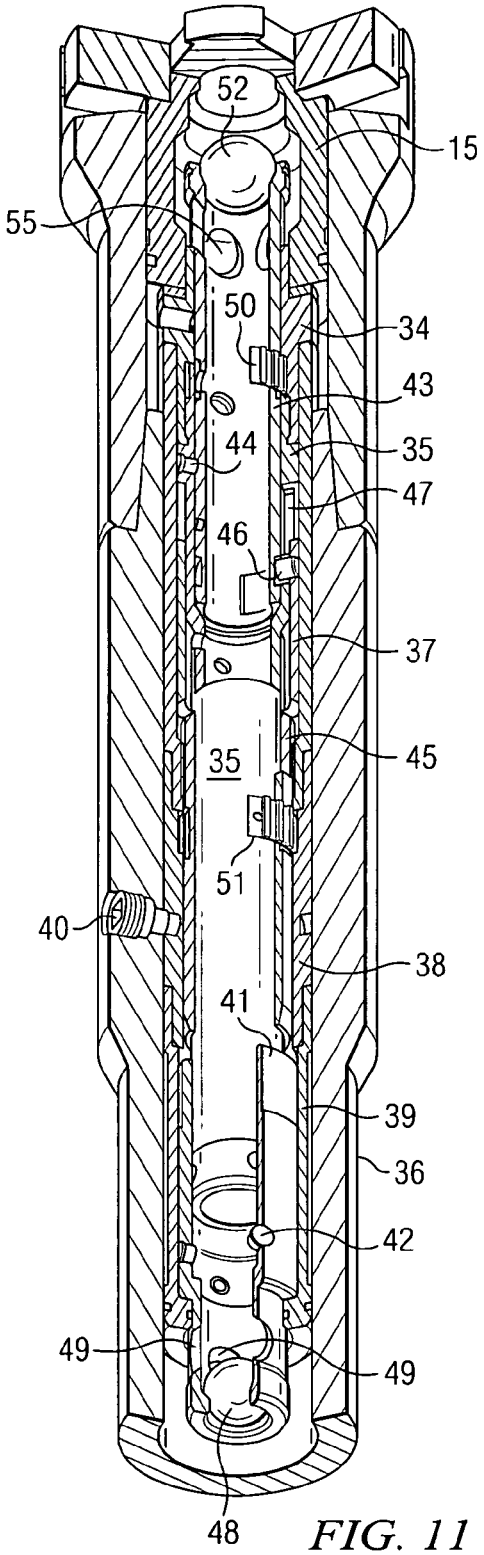
FIG. 11 illustrates a perspective view, with portions broken away, of activation and capture devices in the second positions of the activation and capture devices.

An obturation ball 52 may be introduced into axial cavity 2, as depicted in FIG. 11. Obturation ball 52 closes off the entry of internal tubular slide 43. The abrupt increase in pressure that results from this closure, as well as the mechanical impact of obturation ball 52 on slide 43, has the effect of shearing pins 44 and releasing slide 43 and sleeve 45. Slide 43 and sleeve 45 are coupled and slide downstream together, one inside extension tubes 34 and 35 and the other between extension tube 35 and sockets 37 and 38 of joining element 36.

During this sliding, clamping collar 50 comes to be fixed in an external housing 53 in slide 43, thereby coupling slide 43 to hollow piston 15 by extension tube 34. Clamping collar 51 also comes to be fixed in an external housing 54 provided on sleeve 45 fixed to hollow piston 15. This fixes sleeve 45 to socket 38 and thereby to tubular body 1.

In the capture position, circulation of drilling muds is re-established in axial cavity 2 by lateral passages 55. Lateral passages 55 make it possible to short-circuit ball 52 and re-establish flow around ball 52. Once the movable parts are fixed, the tool may be raised to the surface.

Figure 14:
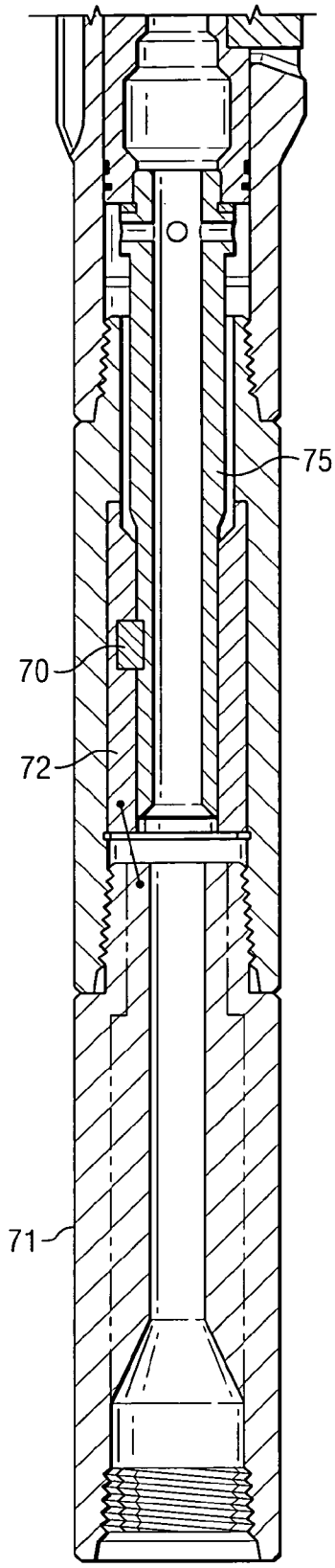
FIG. 14 illustrates an alternative embodiment of an activation and capture device in accordance with a particular embodiment of the present invention.

With reference to FIG. 14, for example, the activation device may include a bolt 70 that in a closed position, axially holds hollow piston 15 inside tubular body 1 in the initial position. An electric control member 71, coupled to a bolt activator 72, may be capable of controlling a movement of the bolt into an open position in which it releases hollow piston 15, or an extension 75 of hollow piston 15.

The tool may also include a bolt that, in a closed position, holds the capture device in a non-activated position. An electric control member could be coupled to a bolt activator and be capable of controlling a movement of the bolt into an open position in which it releases the capture device so that it makes a movement into the capture position. In particular embodiments, the activation and deactivation of the tool may be controlled by a single bolt, such as, for example, the bolt illustrated in FIG. 14.

Figure 15:
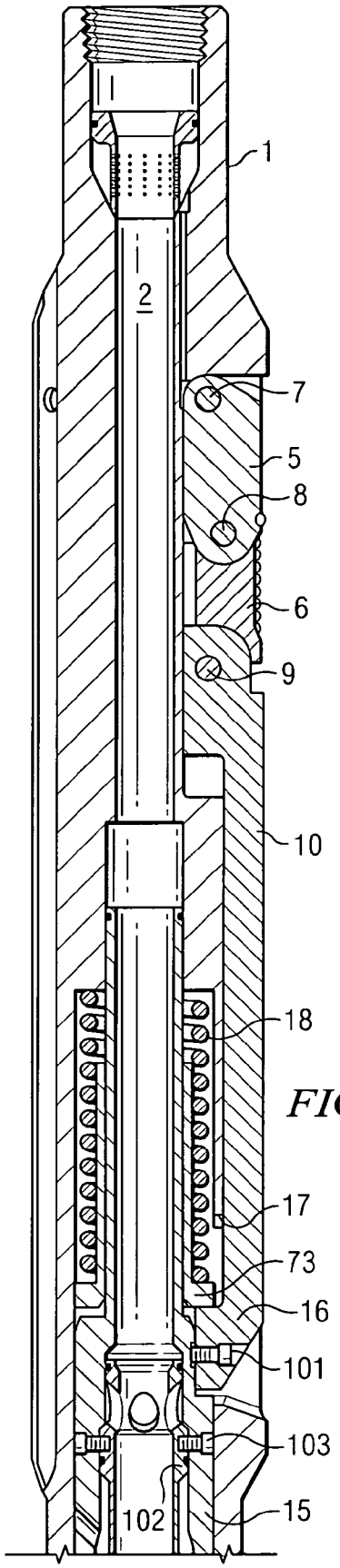
FIG. 15 illustrates a longitudinal cross section view of an upstream portion of a tool including activation and capture devices in their de-activated positions.
Figure 16:
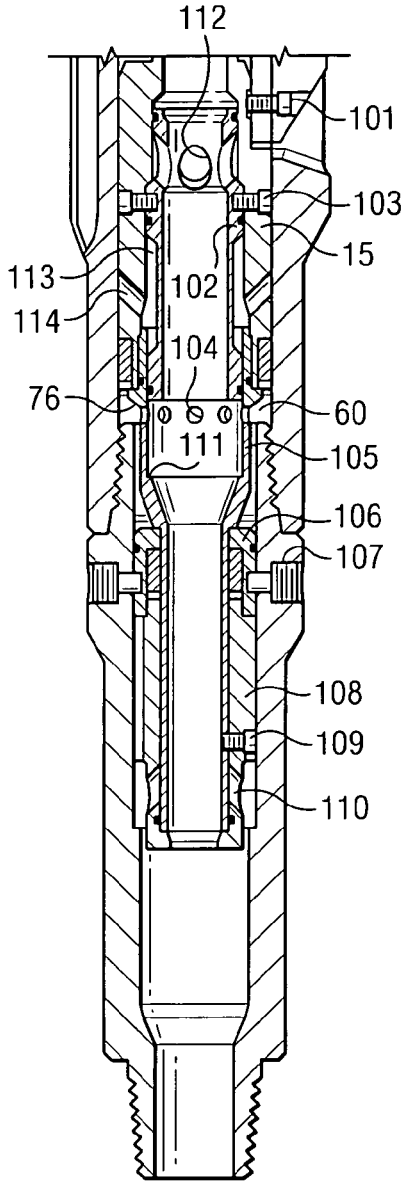
FIG. 16 illustrates a longitudinal cross section view of a downstream portion of the tool in FIG. 15 including activation and capture devices in their de-activated positions.

FIGS. 15 and 16 illustrate a particular embodiment including an activation and de-activation device. In the example embodiment illustrated in FIGS. 15 and 16, the activation device and the de-activation device are in their inactive positions. The piston 15 and transmission element 10 are arranged with respect to each other by means of a positioning pin 101. A tubular slide 102 is held by shear pins 103 to an inner cavity of the piston 15. At the downstream end of the piston 15, an intermediate sleeve 105 is arranged between the piston and the downstream end of the tubular slide 102. Intermediate sleeve 105 is fixedly coupled to piston 15 and projects from the downstream end of piston 15 in the downstream direction. Intermediate sleeve 105 has peripheral orifices 104 located downstream from the connection between piston 15 and intermediate sleeve 105 that allow a drilling mud to enter annular chamber 60. The drilling mud entering annular chamber 60 may exert a pressure on surface 76 of the piston 15.

As illustrated in FIG. 16, the intermediate sleeve 105 abuts a stop ring 106 that is fixedly coupled to an extension of tubular body 1 by fixing screws 107. Downstream of stop ring 106 is a sliding tube 108. Sliding tube 108 is arranged around a downstream portion of the intermediate sleeve 105 and is fixed to intermediate sleeve 105 by a shear pin 109. The upstream end of sliding tube 108 abuts the downstream end of stop ring 106.

A ball may be introduced into axial cavity 2 to close off the thinned downstream end of sliding tube 108. When the thinned downstream end of sliding tube 108 is closed off, the hydraulic pressure inside the axial cavity 2 will increase abruptly. The increased pressure and the mechanical impact of the ball on sliding tube 108 will cause shear pin 109 to be sheared. Sliding tube 108 will thereby be released to move downstream. Passage of the drilling mud may be re-established through lateral holes 110 in the sliding tube 108. Lateral holes 110 are blocked by intermediate sleeve 105 and become cleared as sliding tube 108 moves downstream.

An adequate increase in hydraulic pressure in the chamber 60 will now result in piston 15 sliding upwards, accompanied by intermediate sleeve 105 and tubular slide 102. Piston 15 will compress return spring 18 and direct a movement of the transmission element 10 longitudinally upwards and a movement of the cutting arms 5 and 6 outwards.

In order to raise the tool, the internal pressure of the mud may be decreased to return piston 15 to its initial position with cutting arms 5 and 6 in the retracted position. A ball of appropriate size may then be introduced into axial cavity 2 to lodge in the thinned upstream portion of tubular slide 102. When the ball lodges against the thinned upstream portion of tubular slide 102, the hydraulic pressure inside axial cavity 2 will abruptly increase. The effect of this increase in pressure, as well as the mechanical impact of the ball on the tubular slide 102, will cause shear pins 103 to be sheared. The tubular slide 102 is thus released to move downstream. The downstream movement of tubular slide 102 is limited by a bearing shoulder 111 inside an upstream cavity of the intermediate sleeve 105. Flow of the drilling mud may then re-established through lateral holes 112 in tubular slide 102. As illustrated in FIG. 16, lateral holes 112 are blocked by the intersection of piston 15 and tubular slide 102. As tubular slide 102 moves downstream relative to piston 15, lateral holes 112 are no longer blocked and allow flow of the drilling mud.

As can be seen in FIG. 16, the tubular slide 102 has a central portion with a reduced outer diameter. The reduced diameter portion defines an annular space 113 between tubular slide 102 and piston 15. When tubular slide 102 abuts bearing shoulder 111, annular space 113 provides for fluid communication through peripheral orifices 114 between annular chamber 60 and the drilling mud circulating outside tubular body 1. In this state, piston 15 is immobilized as the pressure of the drilling mud inside annular chamber 60 remains less than or equal to the pressure of the mud circulating outside tubular body 1 plus the force of return spring 18.

In certain embodiments, the surfaces on which the external and internal pressures apply may be such that piston 15 is pushed in a downstream direction. Such a situation adds a hydraulic force to the spring force of return spring 18 to retract cutting arms 5 and 6 and to return and maintain piston 15 in a position corresponding to the withdrawn position of cutting arms 5 and 6.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A drilling tool, comprising:

a tubular body defining a longitudinal axial cavity extending therethrough and defining at least one cutter element recess;

a cutter element at least partially disposed within the at least one cutter element recess and including at least first and second cutting arms at least substantially disposed within the cutter element recess in a retracted position;

the first and second cutting arms operable to move from the retracted position to an extended position in which the first and second cutting arms extend at least partially beyond a periphery of the tubular body; and the first and second cutting arms and the tubular body enclosing a space when the first and second cutting arms are in the extended position.

2. The drilling tool of claim 1, wherein an apex of an angle formed by internal surfaces of the first and second cutting arms is positioned within the at least one cutter element recess when the first and second cutting arms are in the extended position.

3. The drilling tool of claim 1, further comprising a transmission element coupled to the cutter element, the transmission element at least partially disposed within the at least one cutter element recess at a first longitudinal axial orientation, the transmission element operable to move the first and second cutting arms from the retracted position to the extended position as the transmission element moves longitudinally from a first longitudinal position to a second longitudinal position while maintaining the first longitudinal axial orientation.

4. The drilling tool of claim 3, further comprising a piston at least partially disposed within the longitudinal axial cavity, the piston abutting the transmission element and operable to move the transmission element from the first longitudinal position to the second longitudinal position as the piston moves from an inactivated position to an activated position.

5. The drilling tool of claim 4, further comprising an activation device coupled to the tubular body, the activation device being operable to hold the piston in the tubular body in the inactivated position, the activation device being further operable to release the piston when the activation device is triggered thereby allowing the piston to move to the activated position.

6. The drilling tool of claim 4, further comprising a capture device coupled to the tubular body, the capture device being operable to hold the piston in the tubular body in the inactivated position when the capture device is triggered.

7. The drilling tool of claim 1, further comprising a first pivot shaft pivotally coupling the first cutting arm with the second cutting arm.

8. The drilling tool of claim 7, further comprising:

a second pivot shaft pivotally coupling the first cutting arm with the tubular body; and a third pivot shaft pivotally coupling the second cutting arm with a transmission element.

9. The drilling tool of claim 8, wherein the first pivot shaft is offset toward the periphery of the tubular body with respect to a plane passing through longitudinal axes of the first and third pivot shafts when the first and second cutting arms are in the retracted position.

10. The drilling tool of claim 1, wherein the first and second cutting arms in the extended position are operable to enlarge a borehole to at least 1.3 times the diameter of the tubular body.

11. The drilling tool of claim 1, further comprising an intermediate position in the movement of the first and second cutting arms between the retracted position and extended position, wherein a force exerted on the first and second cutting arms by a formation to be eroded directs the first and second cutting arms toward the retracted position before the first and second cutting arms reach the intermediate position, and wherein the force exerted on the first and second cutting arms by the formation to be eroded directs the first and second cutting arms toward the extended position after the first and second cutting arms pass the intermediate position.

12. The drilling tool of claim 1, wherein each of the first and second cutting arms comprise a plurality of cutting tips operable to enlarge a borehole when the first and second cutting arms are in the extended position.

13. A drilling tool, comprising:

a tubular body defining a longitudinal axial cavity extending therethrough and defining first, second, and third cutter element recesses;

a first cutter element at least partially disposed within the first cutter element recess and including at least first and second cutting arms at least substantially disposed within the first cutter element recess in a retracted position of the first and second cutting arms;

a second cutter element at least partially disposed within the second cutter element recess and including at least third and fourth cutting arms at least substantially disposed within the second cutter element recess in a retracted position of the third and fourth cutting arms;

a third cutter element at least partially disposed within the third cutter element recess and including at least fifth and sixth cutting arms at least substantially disposed within the third cutter element recess in a retracted position of the fifth and sixth cutting arms;

the first and second cutting arms operable to move from the retracted position of the first and second cutting arms to an extended position of the first and second cutting arms in which the first and second cutting arms extend at least partially beyond a periphery of the tubular body;

the third and fourth cutting arms operable to move from the retracted position of the third and fourth cutting arms to an extended position of the third and fourth cutting arms in which the third and fourth cutting arms extend at least partially beyond a periphery of the tubular body;

the fifth and sixth cutting arms operable to move from the retracted position of the fifth and sixth cutting arms to an extended position of the fifth and sixth cutting arms in which the fifth and sixth cutting arms extend at least partially beyond a periphery of the tubular body;

the first and second cutting arms and the tubular body enclosing a first space when the first and second cutting arms are in the extended position of the first and second cutting arms;

the third and fourth cutting arms and the tubular body enclosing a second space when the third and fourth cutting arms are in the extended position of the third and fourth cutting arms;

the fifth and sixth cutting arms and the tubular body enclosing a third space when the fifth and sixth cutting arms are in the extended position of the fifth and sixth cutting arms;

wherein an apex of a first angle formed by internal surfaces of the first and second cutting arms is positioned within the first cutter element recess when the first and second cutting arms are in the extended position of the first and second cutting arms;

wherein an apex of a second angle formed by internal surfaces of the third and fourth cutting arms is positioned within the second cutter element recess when the third and fourth cutting arms are in the extended position of the third and fourth cutting arms;

wherein an apex of a third angle formed by internal surfaces of the fifth and sixth cutting arms is positioned within the third cutter element recess when the fifth and sixth cutting arms are in the extended position of the fifth and sixth cutting arms;

a first transmission element coupled to the first cutter element, the first transmission element at least partially disposed within the first cutter element recess, the first transmission element operable to move the first and second cutting arms from the retracted position of the first and second cutter elements to the extended position of the first and second cutter elements as the first transmission element moves longitudinally from a first longitudinal position of the first transmission element to a second longitudinal position of the first transmission element;

a second transmission element coupled to the second cutter element, the second transmission element at least partially disposed within the second cutter element recess, the second transmission element operable to move the third and fourth cutting arms from the retracted position of the third and fourth cutter elements to the extended position of the third and fourth cutter elements as the second transmission element moves longitudinally from a first longitudinal position of the second transmission element to a second longitudinal position of the second transmission element;

a third transmission element coupled to the third cutter element, the third transmission element at least partially disposed within the third cutter element recess, the third transmission element operable to move the fifth and sixth cutting arms from the retracted position of the fifth and sixth cutter elements to the extended position of the fifth and sixth cutter elements as the third transmission element moves longitudinally from a first longitudinal position of the third transmission element to a second longitudinal position of the third transmission element;

a piston at least partially disposed within the longitudinal axial cavity, the piston abutting the first, second, and third transmission elements, the piston operable to move the first, second, and third transmission elements from the first longitudinal positions to the second longitudinal positions as the piston moves from an inactivated position to an activated position.

14. A method of underreaming, comprising:

disposing a cutter element at least partially within a cutter element recess defined by a tubular body, the cutter element including at least first and second cutting arms at least substantially disposed within the cutter element recess in a retracted position;

moving the first and second cutting arms from the retracted position to an extended position in which the first and second cutting arms extend at least partially beyond a periphery of the tubular body; and wherein the first and second cutting arms and the tubular body enclose a space when the first and second cutting arms are in the extended position.

15. The method of claim 14, wherein an apex of an angle formed by internal surfaces of the first and second cutting arms is positioned within the at least one cutter element recess when the first and second cutting arms are in the extended position.

16. The method of claim 14, further comprising:

coupling a transmission element to the cutter element, the transmission element at least partially disposed within the at least one cutter element recess at a first longitudinal axial orientation; and moving the first and second cutting arms from the retracted position to the extended position by moving the transmission element from a first longitudinal position to a second longitudinal position while maintaining the first longitudinal axial orientation.

17. The method of claim 16, further comprising:

disposing a piston at least partially within a longitudinal axial cavity of the tubular body, the piston abutting the transmission element; and moving the transmission element from the first longitudinal position to the second longitudinal position by moving the piston moves from an inactivated position to an activated position.

18. The method of claim 17, further comprising:

coupling an activation device to the tubular body;

holding the piston in the tubular body in the inactivated position with the activation device; and triggering the activation device to release the piston thereby allowing the piston to move to the activated position.

19. The method of claim 17, further comprising:

coupling a capture device to the tubular body; and triggering the capture device to hold the piston in the tubular body in the inactivated position.

20. The method of claim 14, further comprising pivotally coupling the first cutting arm with the second cutting arm with a first pivot shaft.

21. The method of claim 20, further comprising:

pivotally coupling the first cutting arm with the tubular body with a second pivot shaft; and pivotally coupling the second cutting arm with a transmission element with a third pivot shaft.

22. The method of claim 21, wherein the first pivot shaft is offset toward the periphery of the tubular body with respect to a plane passing through longitudinal axes of the first and third pivot shafts when the first and second cutting arms are in the retracted position.

23. The method of claim 14, further comprising enlarging a borehole to at least 1.3 times the diameter of the tubular body by rotating the tubular body around a longitudinal axis of the tubular body when the first and second cutting arms in the extended position.

24. The method of claim 14, further comprising passing through an intermediate position of the first and second cutting arms while moving the first and second cutting arms between the retracted position and extended position, wherein a force exerted on the first and second cutting arms by a formation to be eroded directs the first and second cutting arms toward the retracted position before the first and second cutting arms reach the intermediate position, and wherein the force exerted on the first and second cutting arms by the formation to be eroded directs the first and second cutting arms toward the extended position after the first and second cutting arms pass the intermediate position.

25. The method of claim 14, further comprising enlarging a borehole, when the first and second cutting arms are in the extended position, using a plurality of cutting tips disposed on each of the first and second cutting arms.

* * * * *